US009615678B1

(12) United States Patent
Lindblom et al.

(10) Patent No.: US 9,615,678 B1
(45) Date of Patent: Apr. 11, 2017

(54) MULTIPURPOSE DISPLAY FIXTURE

(71) Applicant: Streater LLC, Albert Lea, MN (US)

(72) Inventors: Thomas G. Lindblom, Claremont, MN (US); David W. Linn, Alden, MN (US); Wayne Lee Jensen, Ellendale, MN (US); Jessica Andrea Mieritz, Germantown, WI (US)

(73) Assignee: Streater LLC, Albert Lea, MN (US)

( * ) Notice: Subject to any disclaimer, the term of this patent is extended or adjusted under 35 U.S.C. 154(b) by 0 days.

(21) Appl. No.: 15/018,589

(22) Filed: Feb. 8, 2016

(51) Int. Cl.
*A47B 3/00* (2006.01)
*A47F 5/00* (2006.01)
*A47F 5/10* (2006.01)
*A47F 5/16* (2006.01)

(52) U.S. Cl.
CPC ..... *A47F 5/0087* (2013.01); *A47F 5/0018* (2013.01); *A47F 5/108* (2013.01); *A47F 5/16* (2013.01)

(58) Field of Classification Search
CPC ..... A47B 85/00; A47B 3/00; A47F 5/0087; A47F 5/0037; A47F 3/06
USPC ..... 108/115, 13, 11, 18, 15, 17; 211/169, 211/169.1
See application file for complete search history.

(56) References Cited

U.S. PATENT DOCUMENTS 274,162 A * 3/1883 Wilson ..... A47B 27/02 108/9
786,526 A * 4/1905 Sollom ..... A47B 85/06 108/15
948,905 A * 2/1910 Snyder ..... A47B 85/06 108/15
2,598,128 A * 5/1952 Liechty ..... A47B 19/08 108/127
3,216,586 A * 11/1965 Sand ..... A47F 5/10 108/11
3,226,172 A * 12/1965 Bateman ..... A47F 3/00 108/11
3,244,124 A * 4/1966 Schafer ..... A47B 13/00 108/12
3,667,803 A * 6/1972 Ford ..... A47C 16/02 297/119
6,786,162 B1 * 9/2004 Volkmer ..... A47B 5/06 108/115
6,926,278 B2 * 8/2005 Bibi ..... A63F 3/00895 273/284
8,539,888 B2 * 9/2013 Hernandez ..... A47B 85/06 108/115
8,539,889 B1 * 9/2013 Khalaf Allah ..... A47B 85/06 108/115
2015/0033990 A1 * 2/2015 Yeager ..... F41H 5/08 108/15

* cited by examiner

*Primary Examiner* — Jose V Chen
(74) *Attorney, Agent, or Firm* — Thomas J. Nikolai; Nikolai & Mersereau, P.A.

(57) ABSTRACT

A display fixture mounted on wheels and having a panel that can be pivoted between a horizontal and a vertical position may be easily position and configured for use as either a table or a gondola style store fixture to display merchandise by a single person in a store. Latch and stop assemblies may be provided to lock the panel in either the vertical or the horizontal position and to stabilize the fixture against tipping.

8 Claims, 9 Drawing Sheets

MULTIPURPOSE DISPLAY FIXTURE

CROSS-REFERENCED TO RELATED APPLICATIONS

Not applicable

STATEMENT REGARDING FEDERALLY SPONSORED RESEARCH OR DEVELOPMENT

Not applicable

BACKGROUND OF THE INVENTION

1. Field of the Invention

This invention relates to display fixtures used in stores and other environments to display merchandise. More specifically, this invention relates to a display fixture that may be used either as (i) a vertical rack on which merchandise may be displayed, or (ii) table upon which merchandise may be placed.

2. Related Art

A variety of fixtures are used in retail stores to display merchandise to customers. Periodically, store operators will rearrange and reconfigure the store fixtures and the merchandise displayed thereon to entice customers to make purchases.

Many retailers find retail space to be at a premium and also find storage space to be limited. Thus, there is a need for store fixtures that can be reconfigured so they can be used in various ways and thereby eliminate storage issues. An example of such a fixture is shown in U.S. Pat. No. 3,226,172, granted on Dec. 28, 1965, to J. A. M. Bateman. The Bateman patent discloses a merchandise display fixture adapted to be arranged for use either as a table-top counter or as a gondola. As discussed in Bateman, at times it is desirable to display large quantities of merchandise within easy reach of customers, such as during certain promotional sale periods. A common way to display large quantities of merchandise is to stack them on a tabletop. At other times, it becomes desirable to obtain the maximum efficiency in the presentation of the merchandise so as to attract the attention of the customer by the manner in which the merchandise is displayed. Merchandise can be more attractively displayed and more easily examined by the customer using a gondola style fixture. Thus, Bateman discloses an apparatus that can be converted and used either as a tabletop, gondola, or a combination of a gondola and tabletop. Converting Bateman's apparatus is somewhat complex and not easily or efficiently achieved. This will be appreciated by one of ordinary skill in the art reviewing the drawings of the Bateman patent and seeing the many different parts and assemblies that need to be reconfigured to convert Bateman's apparatus.

At the present time there is a real need for display fixtures that can easily, quickly and efficiently be converted between various configurations and which also can be easily moved about and locked in place, all by a single person and in less than a minute. Likewise, there is a real need for such display fixtures that can be converted without any tools and display fixtures that can be converted without extraneous parts (other than shelves and hooks) that are not permanently attached and, thus, can become separated from the display fixture and lost when not in use.

SUMMARY OF THE INVENTION

Easily, quickly and efficiently converting a display fixture can be achieved by providing a display fixture including a base, first and second pillars each secured to the base and projecting upwardly from the base, and a panel member. The panel member comprises a first face and a second face, at least one tabletop panel, at least one grid panel, and a frame adapted to hold the tabletop panel and grid panel. The frame typically will include first and second sides and first and second ends. The panel is coupled to the two pillars by first and second pivot assemblies. These pivot assemblies pivotally attach the sides of the frame to the pillars such that the pivot assemblies define an axis of rotation about which the panel assembly rotates between a vertical position and a horizontal position.

First and second latch assemblies are also provided. These latch assemblies are adapted to releasably lock the panel assembly in either the first vertical position or the second horizontal position. The latch assemblies can be released to enable the panel to be pivoted (rotated) between the first vertical position and the second horizontal position.

When the panel is in the horizontal position, the fixture serves as a table. When the panel is in the vertical position, the fixture serves as a gondola style support system. More specifically, the first and second sides of the panel's frame may be provided with receiver slots similar to the receiver slots used in standard gondola style displays fixtures to mount shelves, bins and the like. The grid panel(s) of the panel assembly likewise allows various hooks and hangers to be coupled to the display fixture to support merchandise.

The above-referenced latch assemblies are very simple and easily operated. A latch assembly is associated with each of the pillars. Each latch assembly includes a stationary pin. Each latch assembly also includes a retractable pin movable between a retracted position and an extended position. Each latch assembly is adapted to lock the panel assembly in both the horizontal position and the vertical position. When the panel assembly is locked in the vertical position, the stationary pin of each latch assembly engages the first face of the panel assembly and the retractable pins of each latch assembly is in its extended position such that the retractable pins engage the second face of the panel assembly. When the panel is locked in the horizontal position, both the stationary pins and the retractable pins engage the first surface. When the retractable pins are retracted, the panel assembly is free to rotate between the first vertical position and the second horizontal position.

To assist the user with moving the display fixture between various locations, a plurality of wheels are attached to the bottom of the base to support the display fixture above a support surface. The wheels may be provided with a locking member so that rotation of the wheels is prevented. The locking members may be disengaged to permit the display fixture to be rolled across the support surface. Some or all of the wheels may be provided with casters to make it easier for the user to steer the fixture as it is being moved between various locations.

Whenever such wheels are provided, there is always the risk that the fixture might tip about the wheels if the weight of the fixture is not (or items the fixture is supporting are not) balanced. To address this problem, various stops may be attached to the bottom of the base. These stops may also be made retractable such that they engage the support surface when it is intended the fixture is to remain stationary. The stops may also then be retracted to permit the fixture to be more easily moved when it is desired to move the fixture.

BRIEF DESCRIPTION OF THE DRAWINGS

The foregoing features, objects and advantages of the invention will become apparent to those skilled in the art from the following detailed description and with reference to the following drawings in which like numerals in the several views refer to corresponding parts.

DETAILED DESCRIPTION

Figure 1:
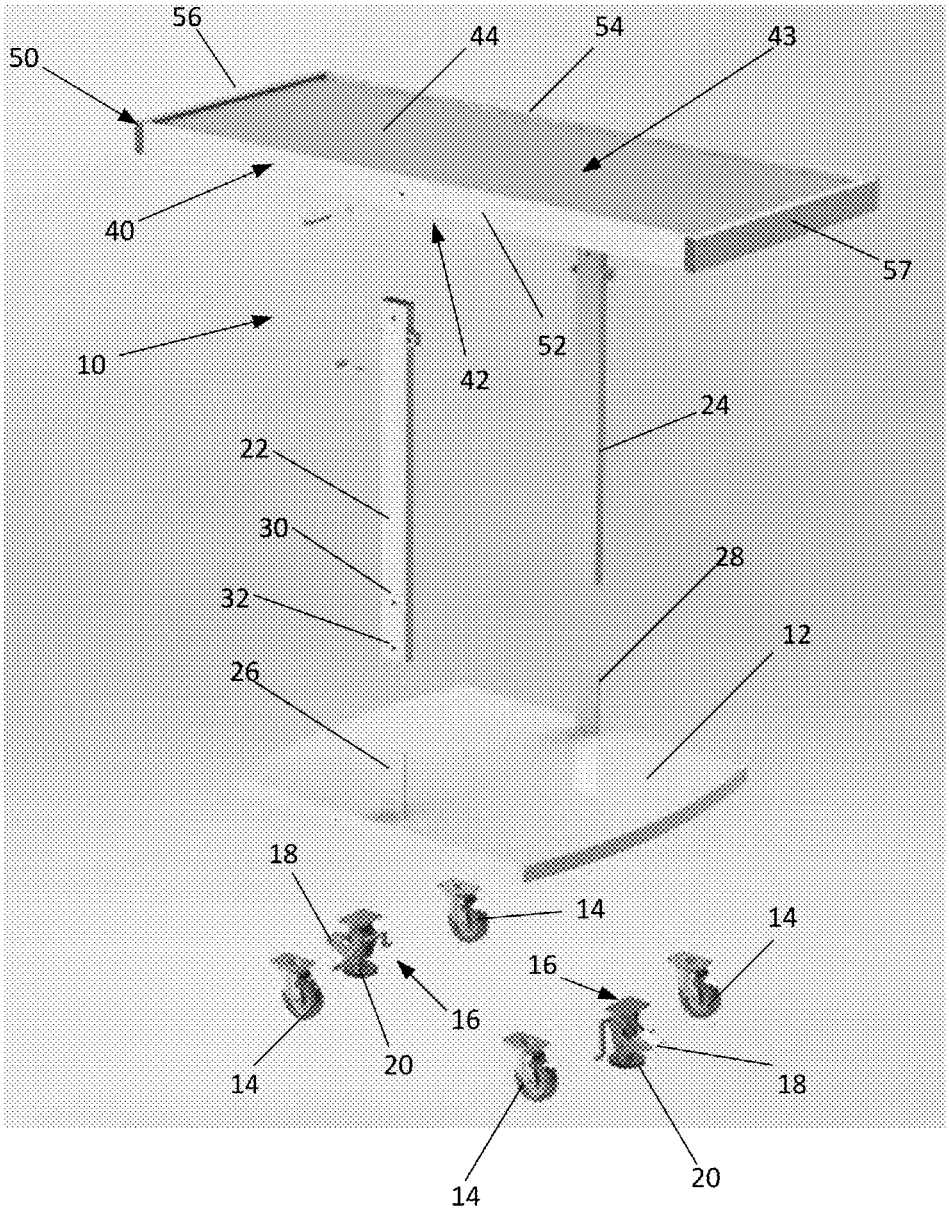
FIG. 1 is a perspective exploded view of a display fixture made in accordance with the present invention with the panel assembly and a first vertical position.

The description of the preferred embodiments is intended to be read in connection with the accompanying drawings, which are to be considered part of the entire written description of this invention. In the description, relative terms such as "lower", "upper", "horizontal", "vertical", "above", "below", "up", "down", "top" and "bottom" as well as derivatives thereof (e.g., "horizontally", "downwardly", "upwardly", etc.) should be construed to refer to the orientation as then described or as shown in the drawings under discussion. These relative terms are for convenience of description and do not require that the apparatus be constructed or operated in a particular orientation. Terms such as "connected", "connecting", "attached", "attaching", "join" and "joining" are used interchangeably and refer to one structure or surface being secured to another structure or surface or integrally fabricated in one piece, unless expressly described otherwise.

A display fixture 10 supported by a support surface 1 (such as the ground or a floor) is illustrated in the various drawings. The display fixture 10 includes a base 12 supported above a support surface 1 by a plurality of wheels 14 coupled to the bottom of base 12. The wheels 14 may be provided with casters to assist in steering the display fixture 10 as the display fixture 10 is moved across the support surface 1. The wheels 14 may also be provided with locks to prevent rotation of the wheels. Such locks and casters are well-known in the art. Such locks may be engaged to fix the position of the display fixture 10.

Figure 10:
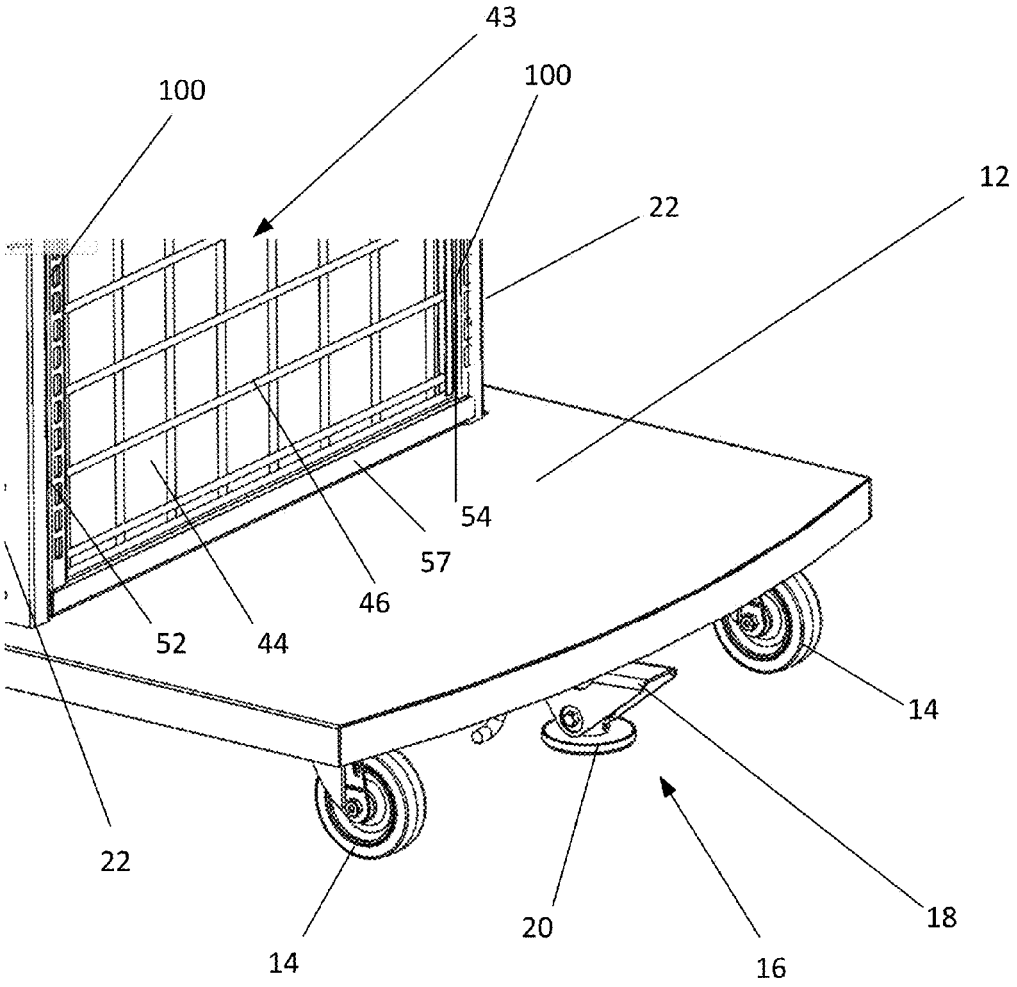
FIG. 10 is a perspective view showing the wheels and stops of the display fixture of FIG. 1.

Also shown in the drawings are a plurality of stops 16 coupled to the bottom of the base 12. Stops 16 serve to prevent the display fixture 10 from tipping relative to the support surface 1 about the axis of rotation of the wheels. The stops 16 include a lever 18 and a pad 20. The lever 18 is actuatable to lower the pad 20 into engagement with support surface 1. When the pad 18 is in this position, the pad prevents tipping of the display fixture 10 about the axis of rotation of the two wheels 14, see, e.g., FIG. 10. The lever 18 is also actuatable to raise the pad 20 slightly off and out of engagement with the support surface 1 so that the display fixture 10 may more easily be transported via the wheels between locations.

The base 12 of display fixture 10 supports a first pillar 22 and a second pillar 24. As one skilled in the art will appreciate from FIG. 1, the pillars 22 and 24 may be attached to the base 12 via upstanding supports 26 and 28 that mate with open bottoms of the respective pillars 22 and 24. The pillars 22 and 24 are then bolted to supports 26 and 28 using standard bolts of sufficient length together with standard washers and nuts via holes 30 and 32. The nuts, bolts and washers are not shown. These nuts, bolts and washers may be eliminated altogether if the supports 26 and 28 are long enough and the tolerances between the inside of the pillars 22 and 24 and supports 26 and 28 are sufficiently tight to prevent unintentional decoupling of the supports and pillars.

The pillars 22 and 24 support a panel assembly 40. The panel assembly has a first face 42 and a second face 43. The panel assembly 40 also includes at least one table top panel 44, for example, a wood panel, and at least one grid panel 46. In FIGS. 1 and 3, the table top panel 44 can be seen. In FIGS. 2, 4, 5 and 10, the table top panel 44 can be seen through the grid panel 46.

The table top panel 44 and the grid panel(s) 46 are held by a frame 50. Frame 50 includes a first side rail 52, a second side rail 54, and a pair of end caps 56 and 57 extended between and joining the side rails 52 and 54. At least one of the end caps 56/57 may be removable so the table top panel 44 and grid panel(s) 46 may be slid in and out of the frame to change the positions of the table top panel 44 and the grid panels 46 in the frame 50. In the configuration shown in FIG. 2, it is advantageous to sandwich the table top panel 44 between two grid panels 46. In the configuration shown in FIG. 3, it is advantageous to place the table top panel 44 over the grid panels 46.

Figure 9:
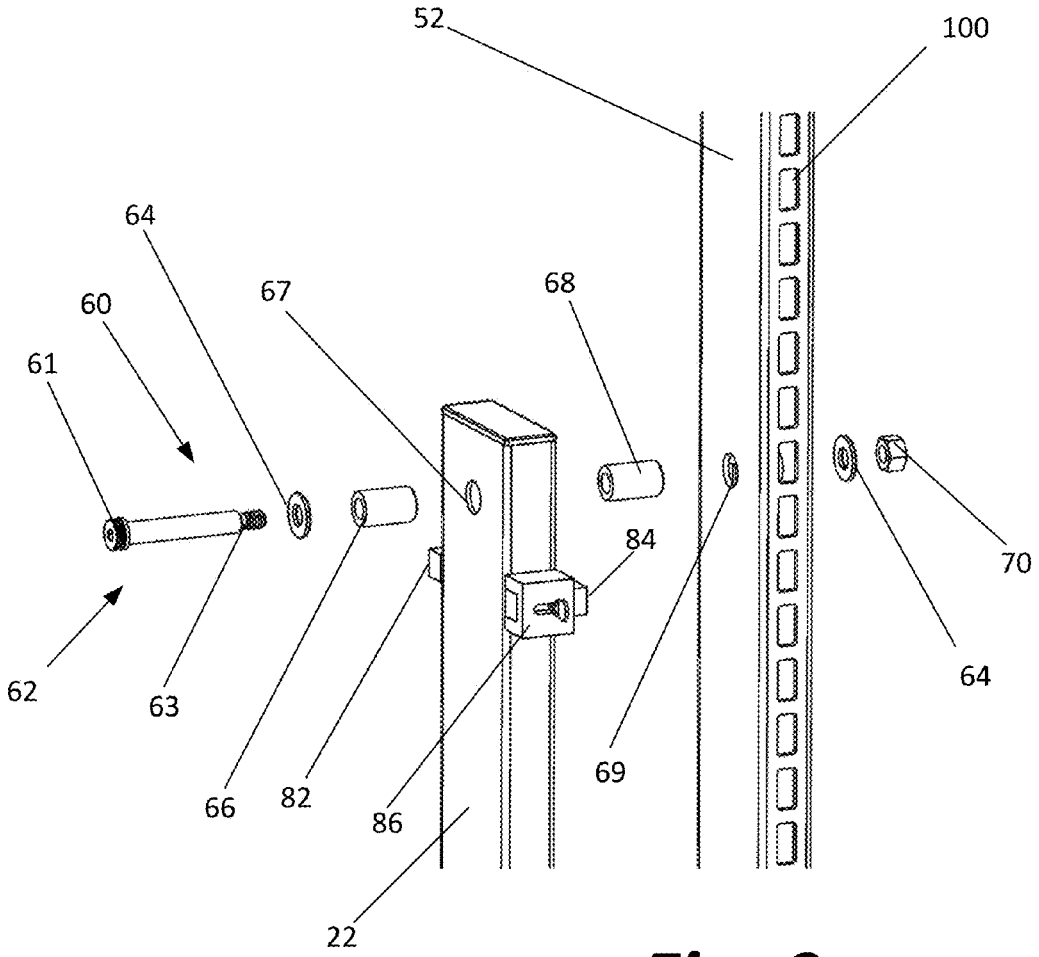
FIG. 9 is an exploded perspective view showing the various components of a pivot assembly the display fixture of FIG. 1.

A first pivot assembly 60 is employed to couple side rail 52 of the frame 50 to pillar 22. An identical second pivot assembly 60 is employed to couple side rails 54 of frame 50 to pillar 22. As best shown in FIG. 9, each pivot assembly 60 includes a bolt 62 having a head 61 and a threaded shaft 63, a plurality of washers 64, a first sleeve 66 adapted to extend through a hole 67 extending through the associated pillar 22/24, a second sleeve 68 adapted to extend through a hole 69 in associated side rail 52/54 of the frame 50, and a nut 70. The threaded shaft 63 of bolt 62 is adapted to pass through the washers 64 and sleeves 66 and 68. The pivot assembly 60 is completed by then threading nut 70 onto threads of threaded shaft 63 of bolt 62 so that the rail of frame 50 is pivotally coupled to the pillar.

Figure 2:
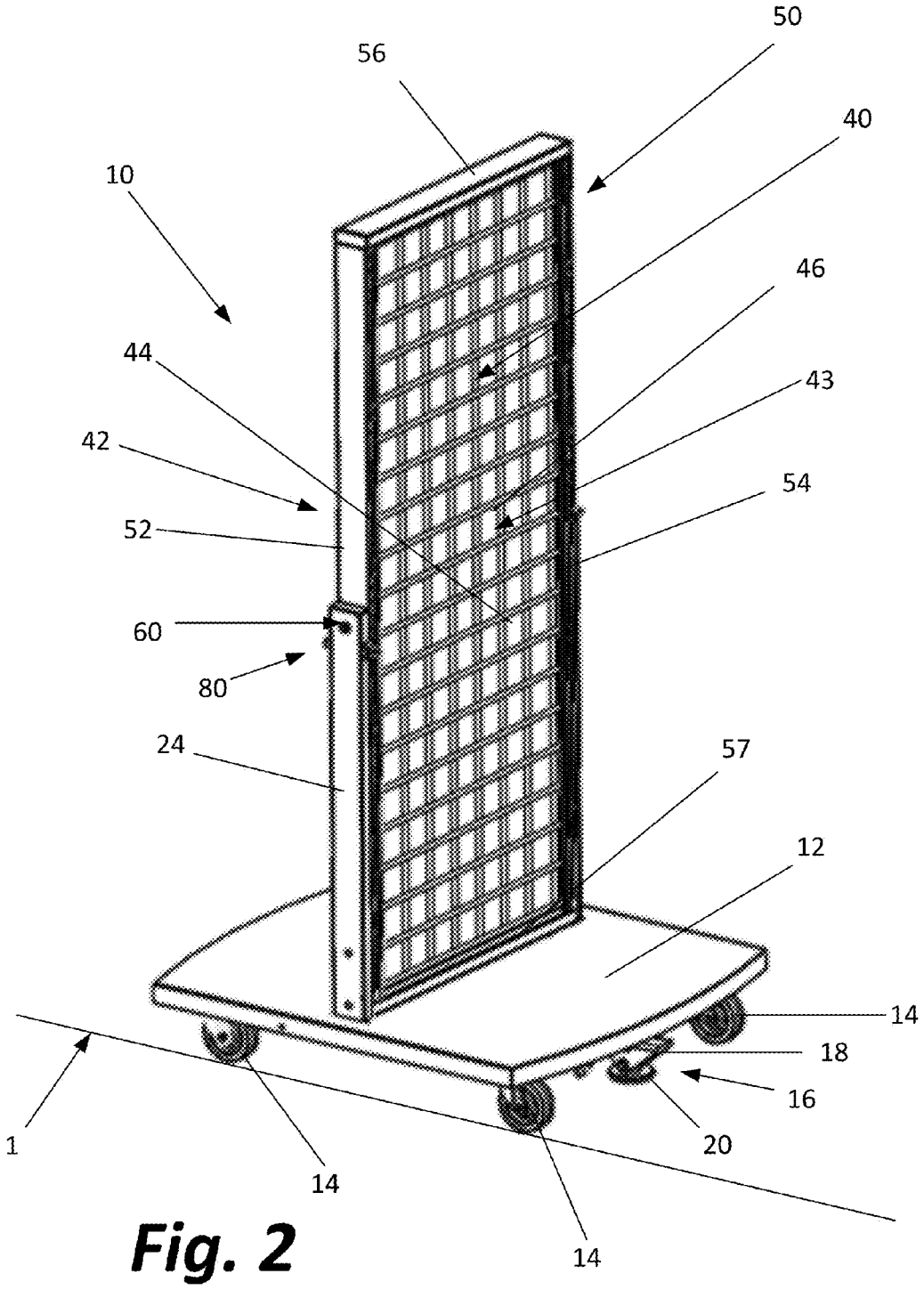
FIG. 2 is a perspective view of the display fixture of FIG. 1 with the panel assembly and a first vertical position.
Figure 3:
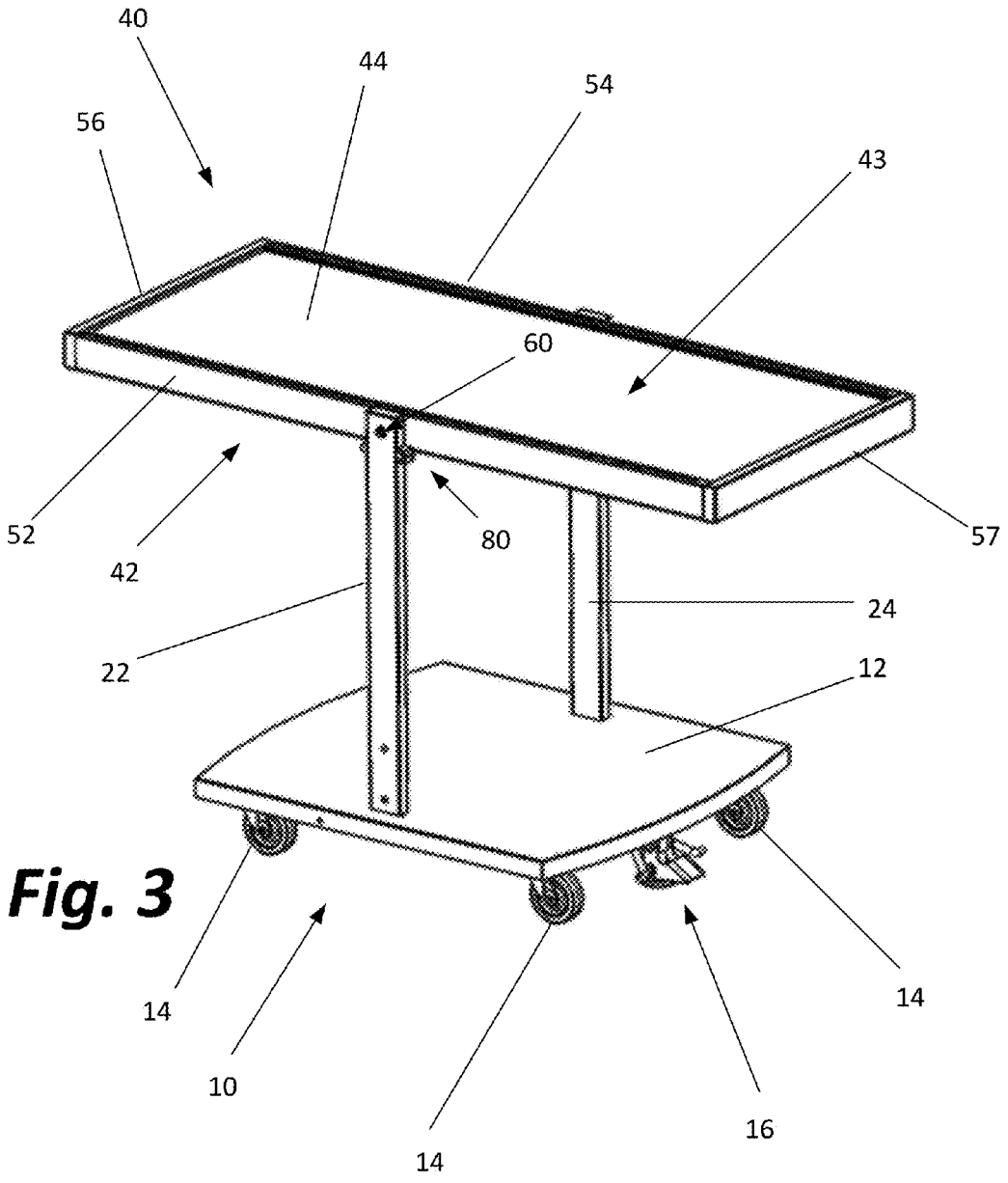
FIG. 3 is a perspective view of the display fixture of FIG. 1 with the panel assembly in a second horizontal position.
Figure 4:
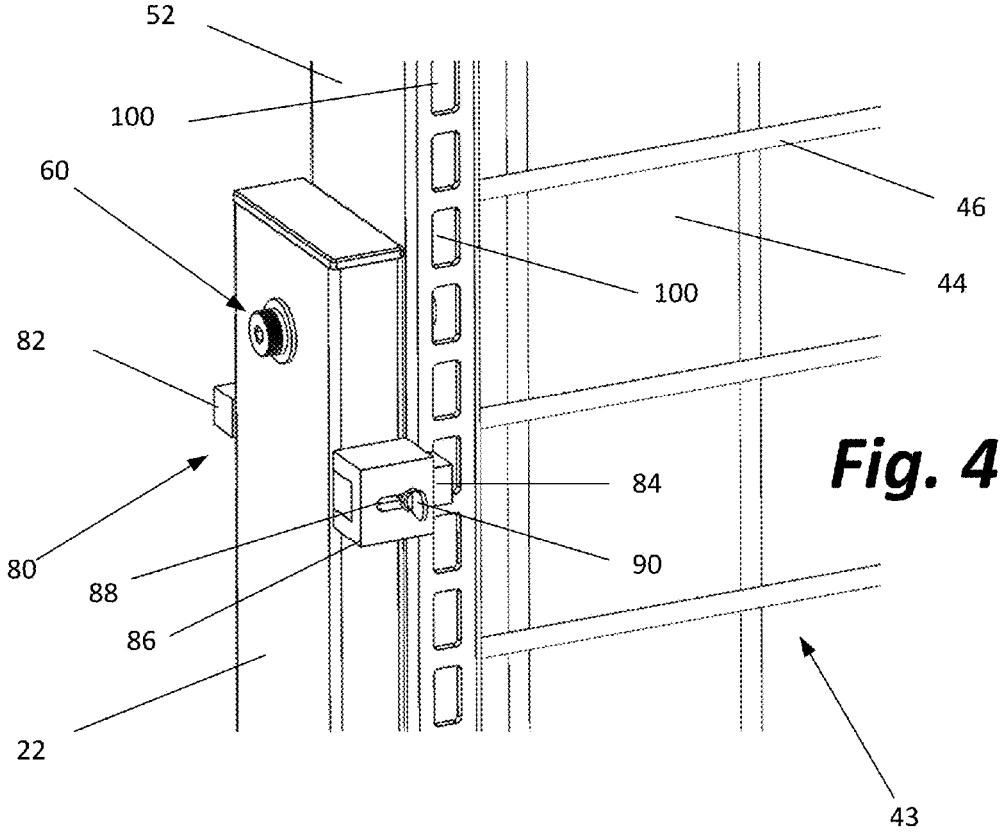
FIG. 4 is a partial perspective view of the display fixture of FIG. 1 with the panel assembly in the first vertical position showing the first face of the panel assembly and how it interacts with the latch assembly.
Figure 5:
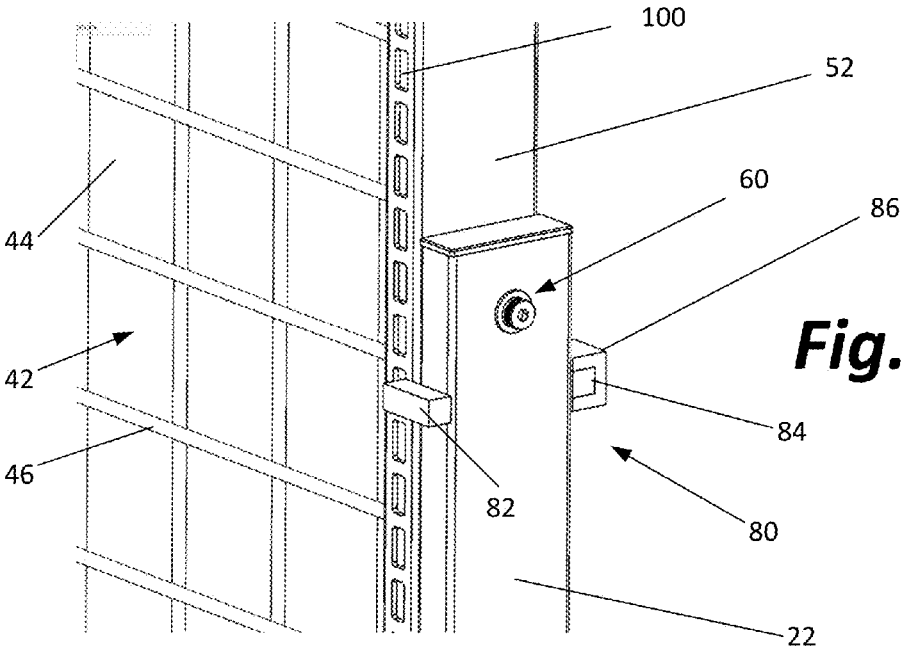
FIG. 5 is a partial perspective view of the display fixture of FIG. 1 with the panel assembly in the first vertical position showing the second face of the panel assembly and how it interacts with the latch mechanism.

Those skilled in the art will appreciate that the bolts 62 of the two pivot assemblies 60 are axially aligned so that the panel assembly 40 is able to rotate between the vertical position shown in FIG. 2 and the horizontal position shown in FIG. 3.

Figure 6:
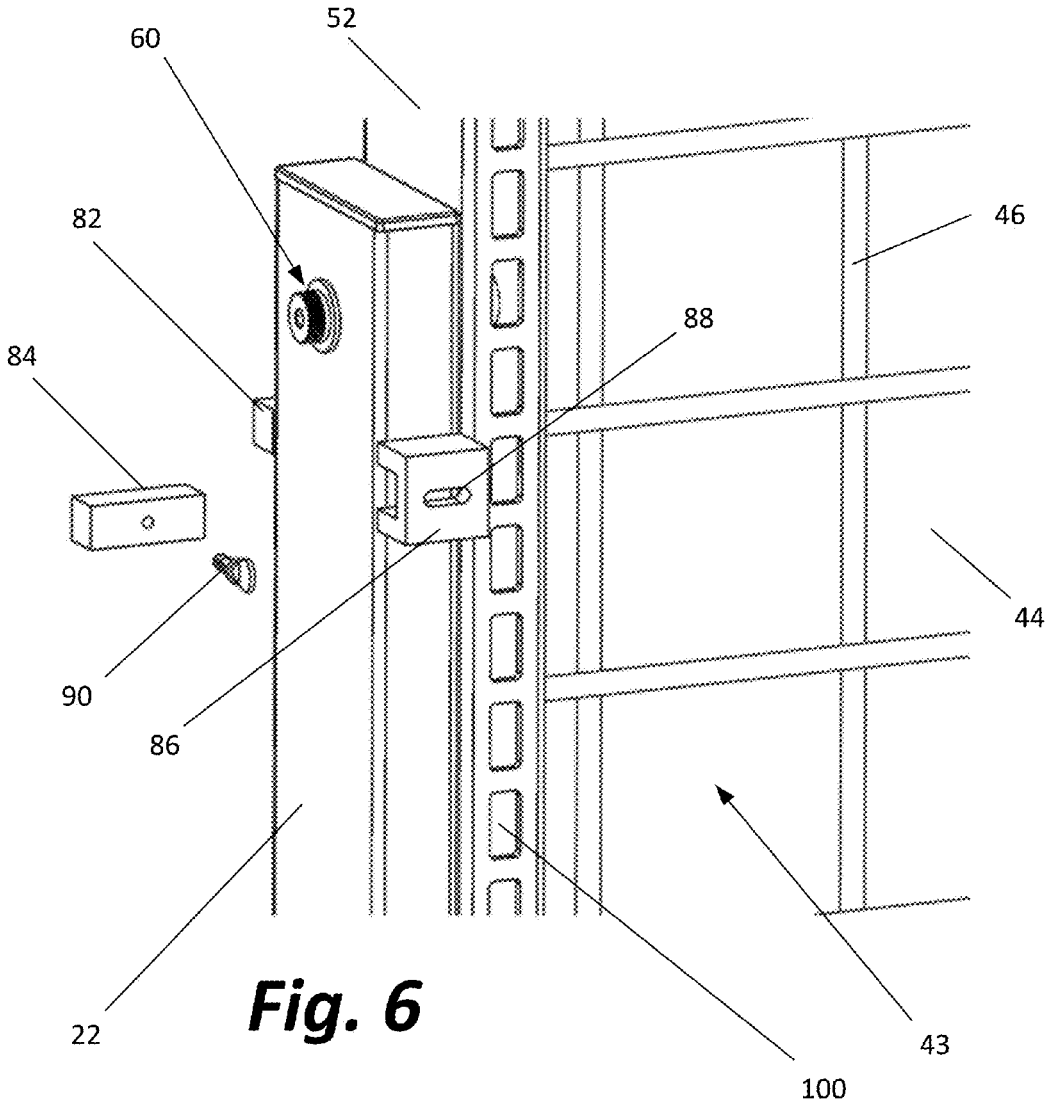
FIG. 6 is a partial perspective view showing the latch assembly and pivot assembly of the display fixture of FIG. 1.

Of course, it is important to be able to selectively lock the panel assembly 40 in both the vertical position of FIG. 2 and the horizontal position FIG. 3. This is achieved by using a pair of latch assemblies like the latch assembly 80 best illustrated in FIGS. 4-6. A latch assembly like latch assembly 80 is coupled to each pillar 22 and 24.

Each latch assembly 80 comprises a stationary pin 82 which is permanently coupled to the pillar 22/24 along one of the sides of the pillar 22/24 and below the axis of rotation defined by the bolts 62 of the pivot assemblies 60. The stationary pivot pins permanently extend from one of the pillars 22/24 toward the other pillar. Each latch assembly 80 further comprises a retractable pin 84 along the opposite side of the pillar 22/24 as the stationary pin 82. Pins 82 and 84 are located at substantially the same height as the pillars 22/24. As shown in FIGS. 4, 6, 7 and 9, the retractable pin 84 is slideably received in a pin housing 86. The pin housing 86 is also provided with a slot 88. A set screw 90 passes through the slot 88 and is turned in a first direction to lock the pin 84 to prevent pin 84 from sliding. The set screw 90 is turned in the opposite direction to unlock the pin 84 and permit it to slide between an extended and a retracted position. The set screw can also be used as a handle to slide the pin 84 in and out when the set screw is turned to the unlocked position.

Figure 7:
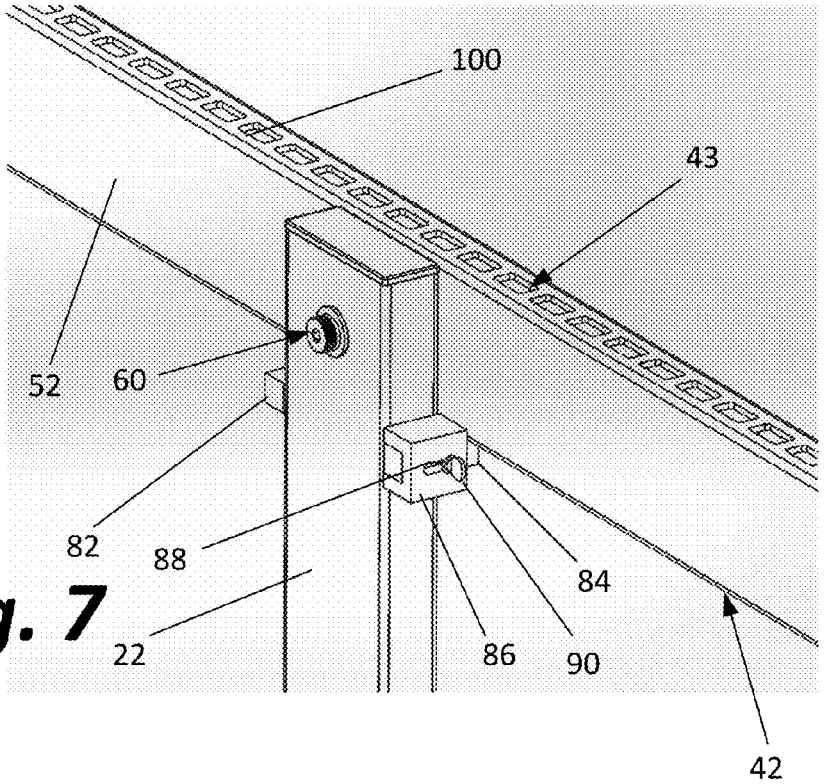
FIG. 7 is a perspective view showing the latch assembly and the pivot assembly of the display fixture of FIG. 1 with the panel assembly in the horizontal position.
Figure 8:
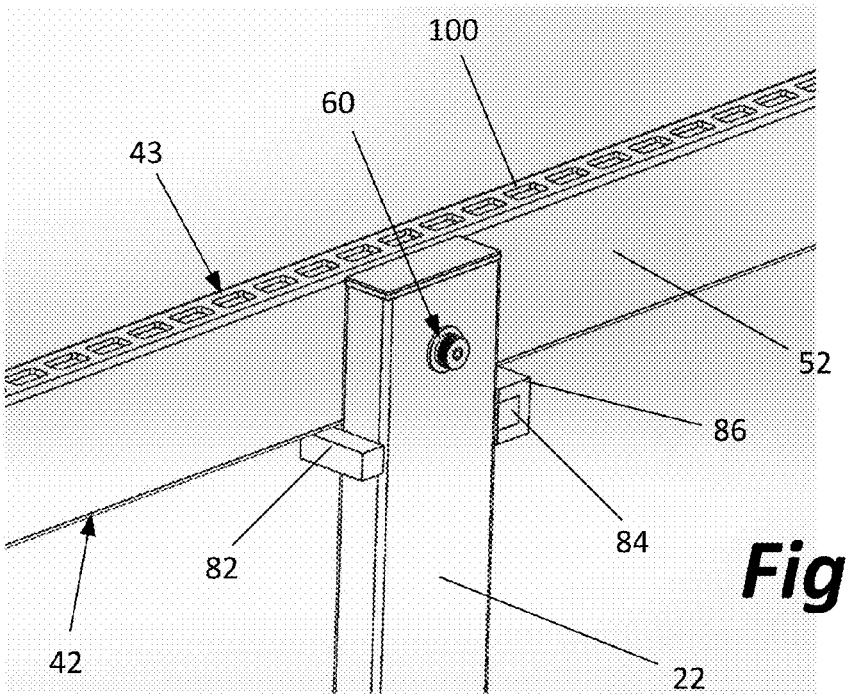
FIG. 8 is a perspective view showing the latch assembly and the pivot assembly of the display fixture of FIG. 1 with the panel assembly in the horizontal position.

As shown in FIGS. 2, 4-6, and 10 the panel assembly 40 is held in the vertical position by latch assemblies 80. Specifically, the stationary pins 82 of the latch assemblies 80 engage the first face 42 of the panel assembly 40 and the retractable pin 84 of each latch assembly 80 engages the second face 43 of the panel assembly 40. More specifically, the side rails 52/54 of the panel assembly are sandwiched between the stationary pin 82 and retractable pin 84 of the associated latch assembly 80. To unlock the panel assembly 40 from the vertical position, the set screws 90 are loosened allowing the user to slide the retractable pins 84 outwardly so they no longer engage the second face 43 of the panel assembly 40. The panel assembly 40 can then be rotated into the position shown in FIGS. 3, 7 and 8. The panel assembly 40 can then be locked in the second horizontal position by extending the retractable pins 84 and tightening the set screws 90 to lock the retractable pins 84 in the their extended position and in face-to-face registration with the first face 42 of panel assembly 40. As shown in FIGS. 7 and 8, both the stationary pins 82 and the retractable pins 84 engage the first face 42 of the panel assembly 40 to hold the panel assembly 40 horizontal. The arrangement of the latch assemblies 80 allows the panel assembly to be repeatedly locked and unlocked and, when unlocked, rotated between the first vertical position and the second horizontal position.

Figure 11:
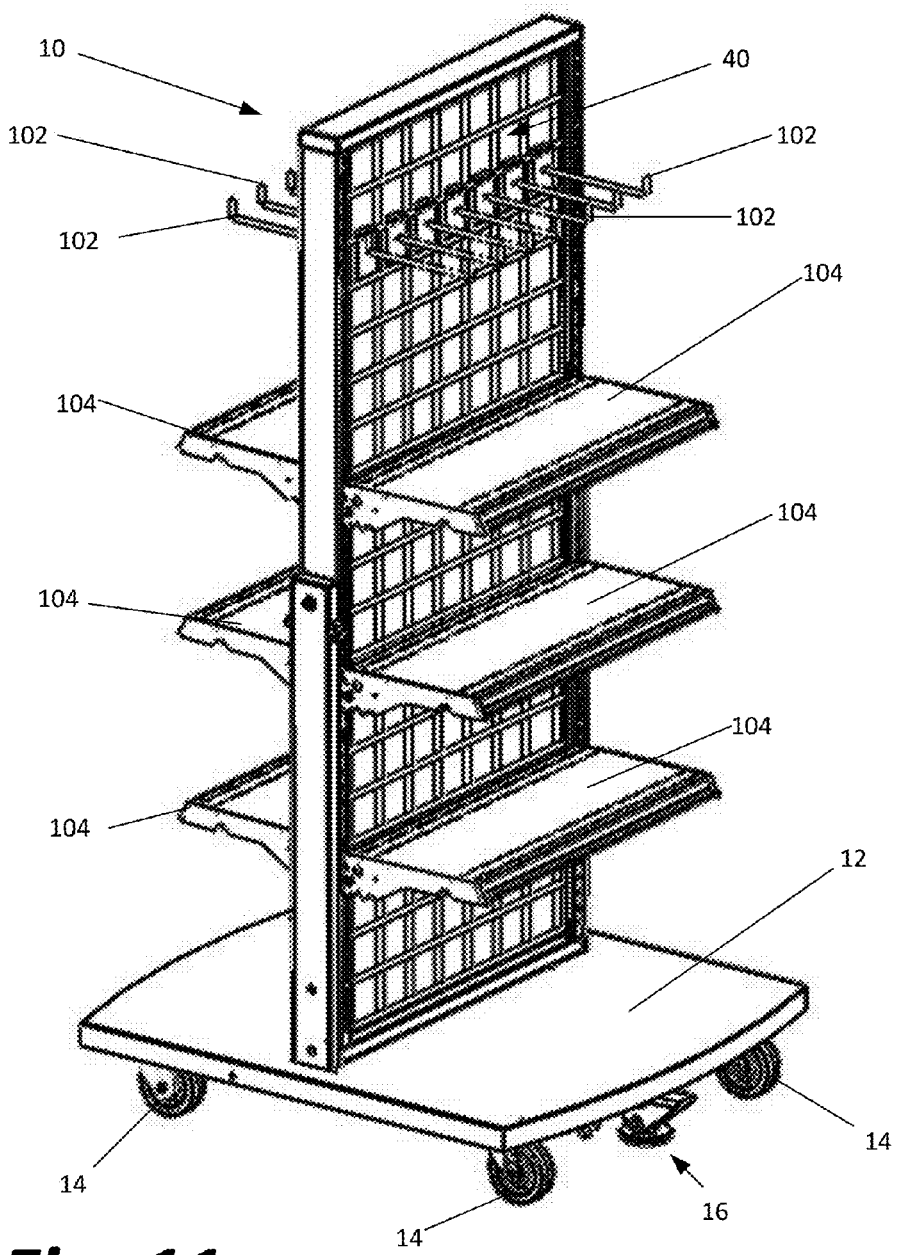
FIG. 11 is a perspective view showing the display fixture of FIG. 1 with the panel assembly in the first vertical position and with hooks and shelves attached.

When in the first vertical position, the display fixture 10 can be used much like any other gondola style fixture. As shown, the side rails of the frames have mounting slots 100 of the type typically used to mount shelves to the vertical supports of a gondola style shelving system. Also, the wires of the grid panels allow various hooks and hangers to be attached to the panel. In FIG. 11, hooks 102 project from the first face 42 and second face 43 of the panel assembly 40 of the display fixture 10. The hooks 102 are secured to grid panels 46 which have been positioned in the frame to sandwich the table top panel 44. Also, shelves 104 project from the first face 42 and the second face 43 of the panel assembly 40. The shelves 104 include hooks adapted to be received within the mounting slots 100 in the front and back sides of rails 52 and 54. The shelves 104 and hooks 102 allow merchandise (not shown) to be displayed using the display fixture 10. The hooks 102 and shelves 104 are adapted to be easily mounted and easily removed. After removal of the hooks 102 and shelves 104, the panel 40 assembly may be rotated into the second horizontal position and the table top panel 44 and the grid panels 46 rearranged in the frame 50 so that the table top panel 44 is on top. When the display panel assembly is in the second horizontal position and the table top panel 44 is on top, the display fixture 10 may be used like any other table and provides a stable horizontal surface for the display of merchandise.

Display fixture 10 can easily, quickly and efficiently be converted between various configurations and can also be easily moved about and locked in place, all by a single person and in less than a minute. Likewise, the display fixture 10 can by converted without any tools. Display fixture 10 can be converted without extraneous parts (other than shelves and hooks) that are not permanently attached. Thus, there are no parts than can become separated from the display fixture and lost when not in use.

From the foregoing, it will also be appreciated that although the specific examples have been described herein for purposes of illustration, various modifications may be made without deviating from the spirit or scope of this disclosure. It is therefore intended that the foregoing detailed description be regarded as illustrative rather than limiting and that the following claims, including all equivalents, are intended to define the invention.

The invention claimed is:

1. A display fixture comprising:

(a) base;

(b) a first pillar and a second pillar each secured to and projecting upwardly from the base;

(c) a panel assembly comprising a first face, a second face, at least one table top panel, at least one grid panel, and a frame adapted to hold the at least one table top panel and the at least one grid panel, said frame including first and second sides;

(d) a first pivot assembly for pivotally attaching the first side of the frame to the first pillar member and a second pivot assembly for pivotally attaching the second side of the frame to the second pillar, wherein said first pivot assembly and second pivot assembly defines an axis of rotation about which the panel assembly rotates between a vertical position and a horizontal position; and (e) a first latch assembly coupled to the first pillar and a second latch assembly coupled to the second pillar, wherein said first latch assembly and second latch assembly are adapted to releasably lock the panel assembly in said first vertical position and said second horizontal position, wherein said first latch assembly and said second latch assembly each comprise a stationary pin, and a retractable pin movable between a retracted position and an extended position wherein when said panel assembly is locked in the vertical position said stationary pins engage the first face of the panel assembly and said retractable pins are in the extended position and engage the second face of the panel assembly, wherein when said panel is locked in the horizontal position and said retractable ins are in the extended position, the stationary pins and retractable pins each engage the first face of the panel assembly, and wherein said retractable pins are in their retracted position, the panel assembly is unlocked and free to rotate between the first vertical position and the second horizontal position.

2. The display fixture of claim 1 wherein the first latch assembly and said second latch assembly each further including a pin housing, a slot in the pin housing and a set screw for securing the retractable pins in their extended position.

3. The display fixture of claim 1 further comprising wheels coupled to and supporting the base and adapted to permit the display fixture to be rolled across a support surface.

4. The display fixture of claim 3 wherein the wheels are provided with a releasable wheel lock adapted to be engaged to prevent rotation of the wheels.

5. The display fixture of claim 4 wherein said stops are adapted to be moved between an extended support surface engaging position and retracted to a position elevated from the support surface.

6. The display fixture of claim 1 further comprising a plurality of stops adapted to prevent the display fixture from tipping about the wheels relative to the support surface.

7. The display fixture of claim 3 wherein at least one of the wheels is castered.

8. The display fixture of claim 1 wherein the first and second sides of the frame member each include a plurality of support receiver slots open to at least one of the first face and the second face.

* * * * *